US005865269A

United States Patent [19]

Eskesen

[11] Patent Number: 5,865,269

[45] Date of Patent: Feb. 2, 1999

[54] ADJUSTABLE HEIGHT AND LEVELABLE WORK SUPPORT

[75] Inventor: Byron H. Eskesen, Tucson, Ariz.

[73] Assignee: Joe D. Hill, Tucson, Ariz.

[21] Appl. No.: 697,140

[22] Filed: Aug. 20, 1996

[51] Int. Cl.[6] ..... E04G 1/00

[52] U.S. Cl. ..... 182/182.2; 182/153; 182/182.1; 182/227

[58] Field of Search ..... 182/153, 181, 182/182, 227

[56] References Cited

U.S. PATENT DOCUMENTS

| | | | |
|---|---|---|---|
| D. 257,396 | 10/1980 | Correll | D25/67 |
| 376,876 | 1/1888 | Goodrich | 182/153 |
| 643,969 | 2/1900 | Milne | 182/182 |
| 850,351 | 4/1907 | Crum | 182/153 |
| 984,846 | 2/1911 | Pichler | 182/182 |
| 2,257,876 | 10/1941 | Berchem et al. | 182/153 |
| 2,347,745 | 5/1944 | McKinney | 182/153 X |
| 3,696,887 | 10/1972 | Brzykey | 182/28 |
| 4,031,981 | 6/1977 | Spencer | 182/153 |
| 4,083,548 | 4/1978 | Hackbarth | 269/166 |
| 4,298,095 | 11/1981 | Jackson et al. | 182/184 |
| 4,375,245 | 3/1983 | Schill | 182/227 X |
| 4,555,100 | 11/1985 | Ditto | 269/166 |
| 4,565,263 | 1/1986 | Southworth | 182/184 |
| 4,711,319 | 12/1987 | Sansotta et al. | 182/155 |
| 4,782,917 | 11/1988 | Schulz | 182/182 |
| 4,804,064 | 2/1989 | Coultrup et al. | 182/155 |
| 4,877,109 | 10/1989 | Welch et al. | 182/183 |
| 5,007,502 | 4/1991 | Shapiro | 182/155 |
| 5,222,420 | 6/1993 | Sorensen et al. | 81/487 |
| 5,314,041 | 5/1994 | Jerrow et al. | 182/181 |

FOREIGN PATENT DOCUMENTS

| | | | |
|---|---|---|---|
| 274581 | 4/1967 | Australia | 182/182 |
| 475455 | 7/1951 | Canada | 182/182 |
| 1086203 | 2/1955 | France | 182/153 |

*Primary Examiner*—Daniel P. Stodola
*Assistant Examiner*—Richard M. Smith

[57] ABSTRACT

A work support device with adjustable length legs used to stabilize the work support on an uneven bearing surface, that is height adjustable, allowing the user to raise a supported work piece to a desired height, and that is levelable in that the user can adjust the work support to level the work piece being supported. Both the adjustable length legs and the height adjustable upper beam are self locking. Unlocking the height adjustable upper beam to allow downward movement is accomplished with finger pressure on a rod. Unlocking the adjustable length leg is accomplished with finger pressure on a lever. The self locking action occurs immediately upon releasing pressure on either the rod or the lever.

13 Claims, 12 Drawing Sheets

ADJUSTABLE HEIGHT AND LEVELABLE WORK SUPPORT

FIELD OF THE INVENTION

This invention relates to a work support similar to a sawhorse, and more particularly, to a work support that is height adjustable in order to raise a supported work piece to the desired height, that is adjustable to level a supported work piece, and that is adjustable to eliminate instability of the work support produced by a non-planar bearing surface.

DESCRIPTION OF PRIOR ART

For many years craftsmen have used various devices to support work pieces such as lumber, gypsum board, etc., so that a supported work piece can be manipulated or altered in some way by a craftsman. One of the most common support devices is identified as a sawhorse and generally consists of two pairs of two legs located and attached near the ends of a connecting rigid beam, the combination of the beam and supporting legs being used to support a work piece.

In its most simple form, the saw horse consists of four pieces of equal length wood serving as legs, being fastened to another larger connecting wood piece serving as a work support beam. Typically two opposing legs are mechanically fastened near each end of the support beam. The legs are usually splayed relative to each other and form an approximate right angle with the longitudinal axis of the support beam. The sawhorse is placed on a floor or similar bearing surface in a manner that allows placement of the work piece on the support beam. Usually used in pairs, the described sawhorse is utilitarian but often is not easily adaptable to varying conditions of a particular work site or to the needs of the craftsman.

Various improved sawhorses are known, for example, sawhorses that are constructed of materials other than wood, some having the ability to be folded or dismantled to facilitate storage and transportation. Some have incorporated tool trays or clamps in an effort to add to the scope of use. Some have incorporated a method of adjusting the length of the legs through the use of a threaded or spring loaded fastener that can change the length of the leg by predetermined increments fixed by the distance between holes or detents in a moveable segment of the leg. Examples of such work support devices and sawhorses are provided by the following patents: U.S. Pat. No. 5,314,041 (Sawhorse); U.S. Pat. No. 4,877,109 (Adjustable Sawhorse and Scaffold); U.S. Pat. No. 4,804,064 (Adjustable, Collapsible Sawhorse); U.S. Pat. No. 4,565,263 (Sawhorse with Extendible and Contractible Leg Assemblies); U.S. Pat. No. 4,298,095 (Work Support Frame); U.S. Pat. No. 3,696,887 (Combination Sawhorse, Scaffold Support and Table); U.S. Pat. No. 5,007,502 (Self-Leveling Sawhorse); U.S. Pat. No. 4,711,319 (Saw Horse).

Past examples of the art attempted to compensate for an uneven bearing surface through the use of adjustable length legs that offered several fixed lengths. These designs are lacking in that small length adjustments between those fixed by the design are not possible. Other designs with adjustable length legs utilized a threaded bolt and nut to jam an interior moveable leg segment against an outside fixed leg segment in order to hold a selected leg length. These designs are lacking in that they are difficult to adjust, hold in position, and screw in the threaded bolt with only two hands. Another example utilizes a manually operated metal clamp acting on a piece of dimension lumber to hold an adjusted leg length. This design appears to be lacking in that the lumber serving as legs is damaged by the teeth in the clamp and will need to be replaced when the damage suffered renders the lumber unusable. Other examples of prior art offer a method of disassembly, or folding and collapsing, to facilitate handling and storage of the device.

None of the prior art examples have the ability to adjust the height of the work support member by raising the support member to the desired working height, and then to level the support member at the selected height.

OBJECTS AND ADVANTAGES

Accordingly, several objects and advantages of the present invention are:

(a) to provide a height adjustable work support member that can be raised or lowered to a desired height position;

(b) to provide a work support member that can be longitudinally leveled at the selected height;

(c) to provide a work support member that can be transversely leveled at the selected height;

(d) to provide a self-locking system that will hold the work support member at the selected height and level condition;

(e) to provide a release mechanism so that the raised work support member can be unlocked and lowered;

(f) to provide length adjustable legs that can be extended or retracted to compensate for work support instability produced by an uneven bearing surface, and can be used to transversely level the work support;

(g) to provide a self-locking system that will hold the length adjustable legs at the selected length;

(h) to provide a release mechanism so that the adjustable length legs can be unlocked and readjusted;

(i) to provide work table support at a desired height and work surface angle when two work supports are used;

(j) to provide a clamp to support and hold a work piece in position;

(k) to provide legs that close to facilitate transportation and storage of the work support;

(l) to provide a durable, versatile and simple work support device.

Further objects and advantages are to provide a simply constructed, reliable and multi-use work support device that is simple to adjust and use, with the added versatility of stability, height adjustment, and levelability. Still further objects and advantages will become apparent from a consideration of the following description and drawings.

DRAWING FIGURES

FIG. 1*a* shows a perspective view of the complete work support device with legs open, and upper beam raised and leveled.

FIG. 1*b* shows a perspective view of the complete work support device with legs closed and upper beam lowered.

Figure 5:
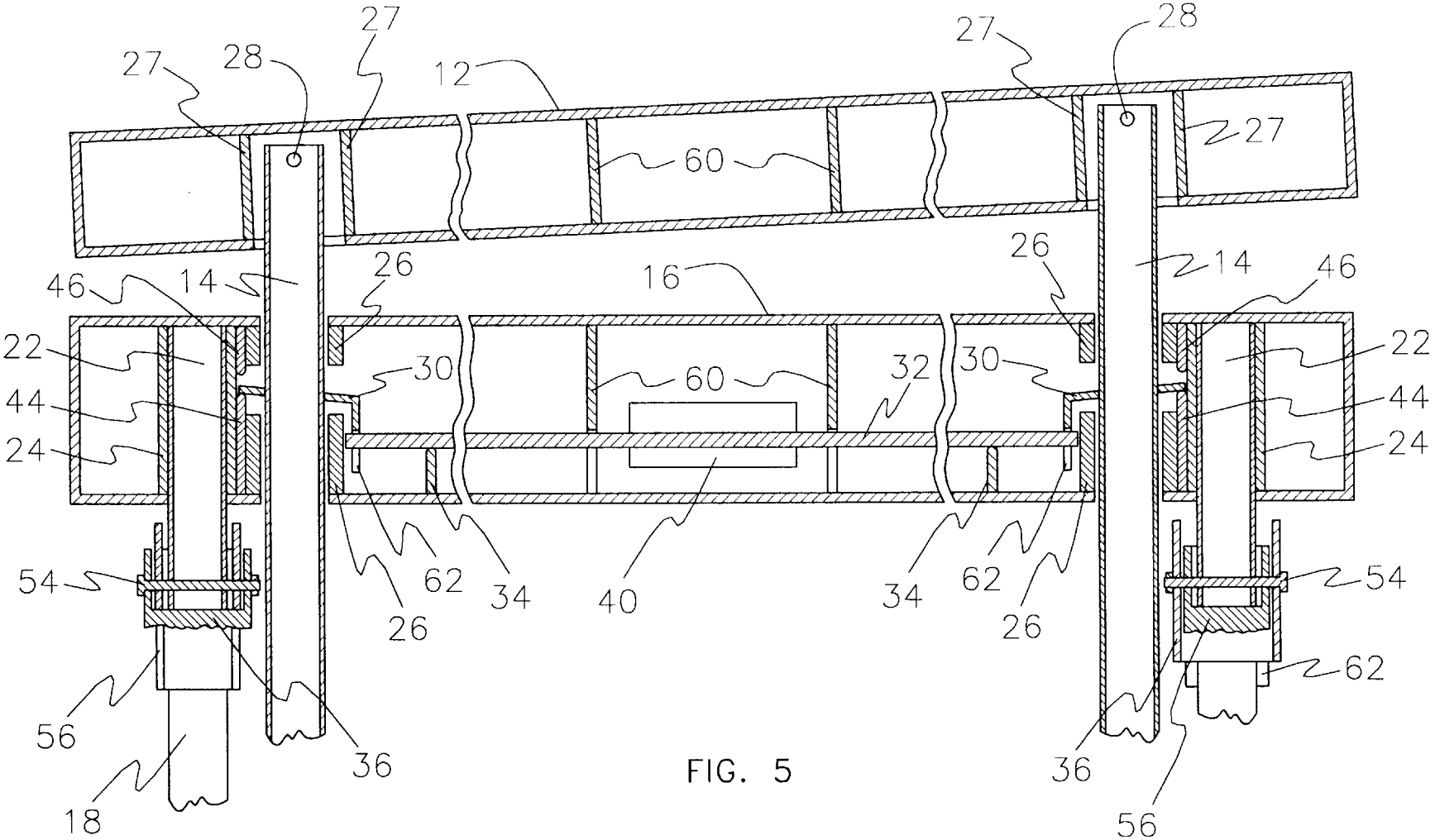
FIG. 5 shows a sectional view of the upper beam, the lower beam, the sliding supports, the two friction lock assemblies, the friction lock release mechanism, the fixed posts, the upper portion of the leg assemblies, and associated parts, along the longitudinal center line.
Figure 5A:
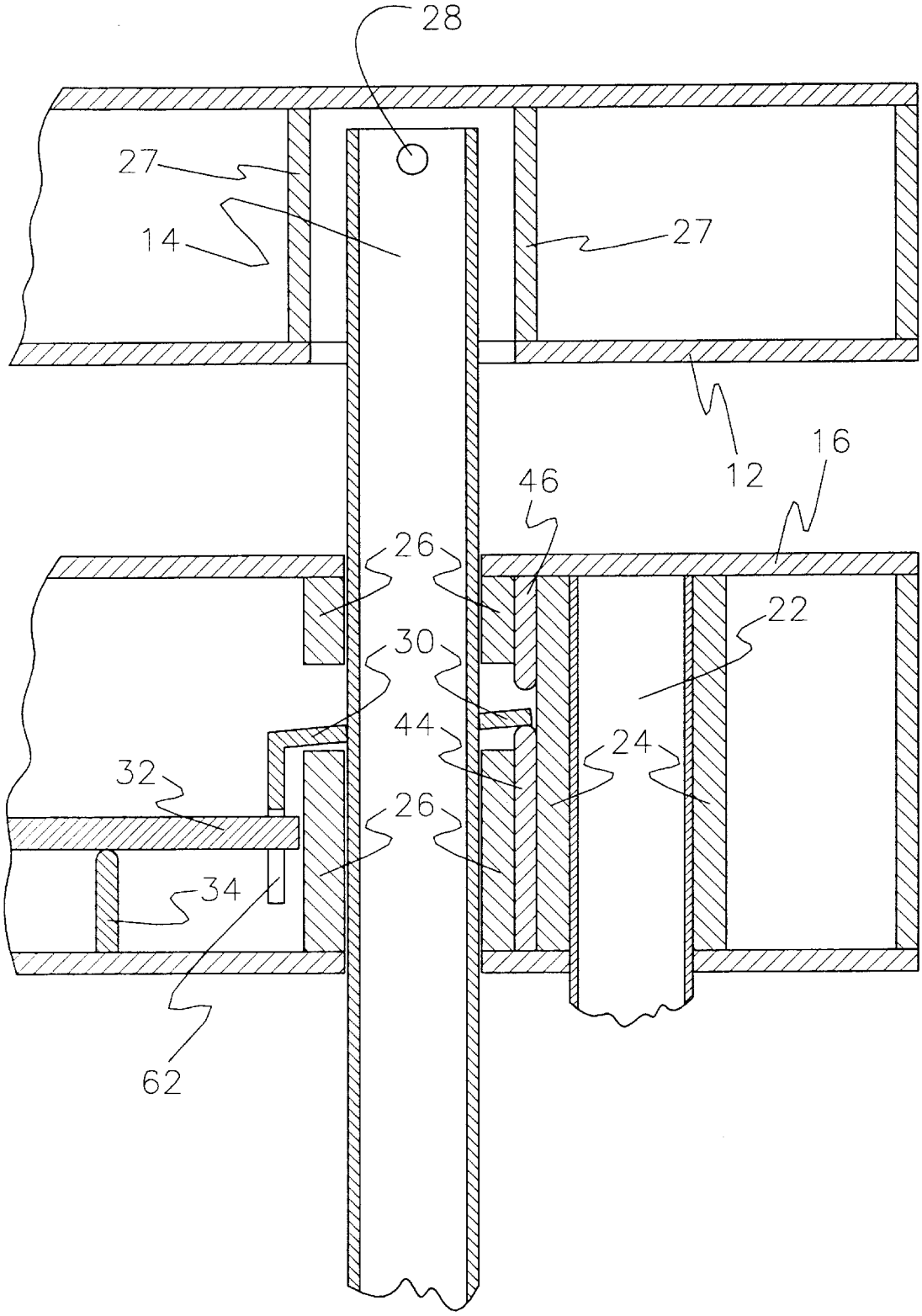

FIG. 5*a* shows a sectional view of one end portion of the two beams, the sliding support, the sliding support friction lock, the associated release mechanism, and associated parts, along the longitudinal center line. This figure is presented to illustrate the self-locking friction lock in the locked position, holding the associated sliding support.

Figure 5B:
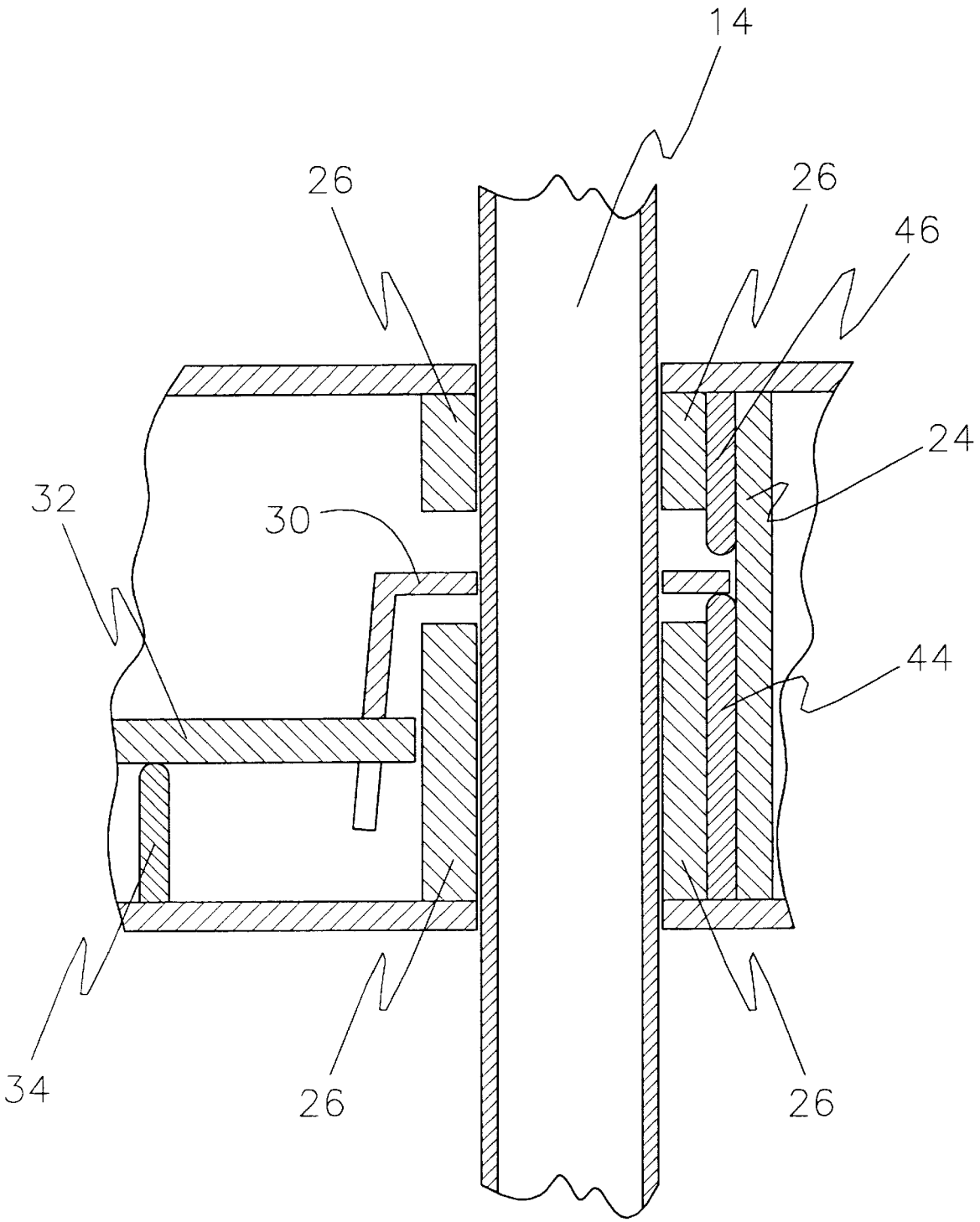

FIG. 5*b* is presented to illustrate the self-locking friction lock in the unlocked position, releasing the associated sliding support.

Figure 6A:
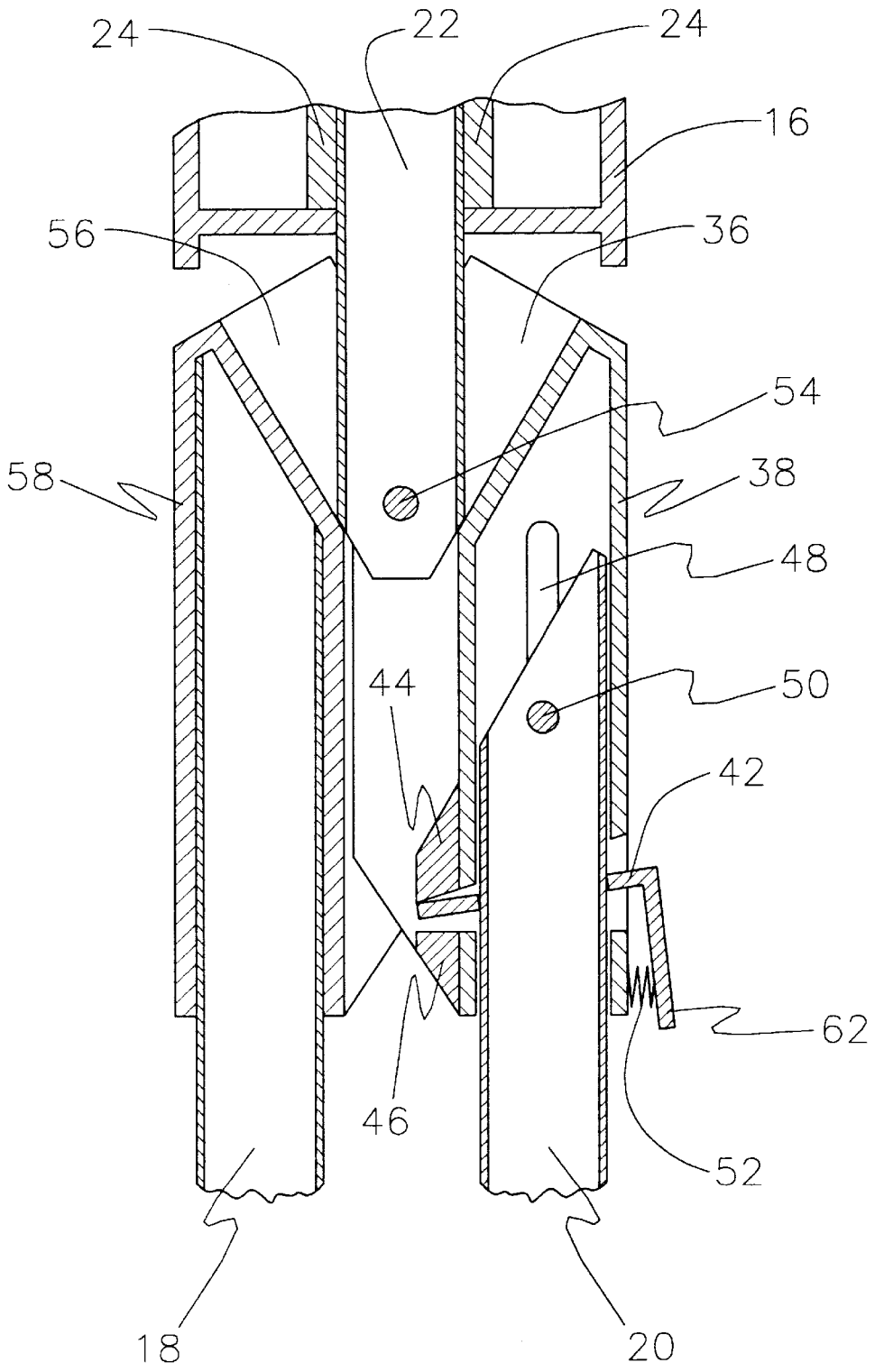

FIG. 6*a* shows a sectional view of two opposing leg assemblies in a closed position, and the fixed post for legs attachment, along the transverse centerline through the fixed post and the two associated leg assemblies. This figure illustrates the internal structure of the leg assemblies and the self-locking friction lock in the locked position, holding the associated adjustable length leg.

Figure 6B:
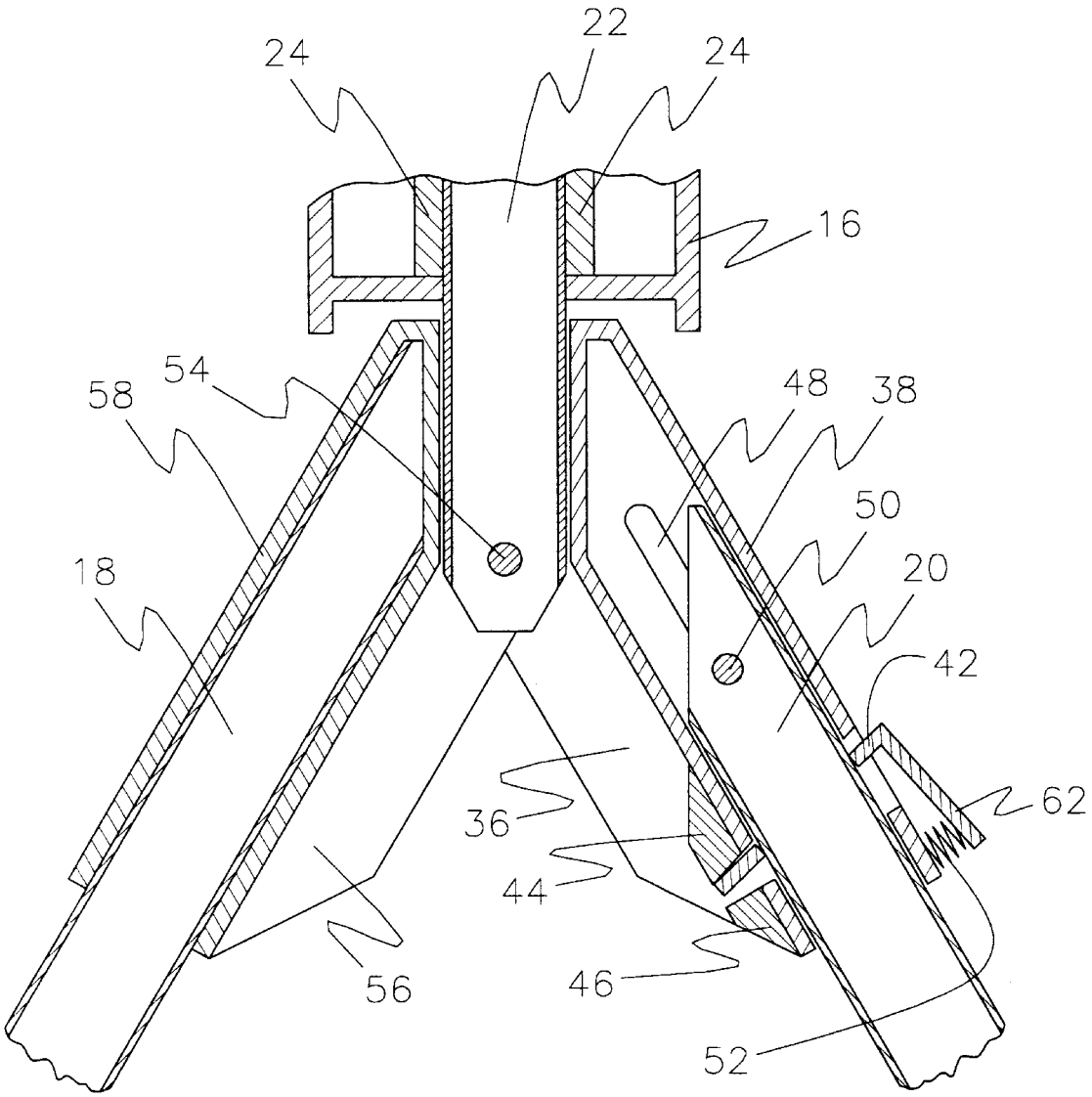

FIG. 6*b* shows a sectional view similar to 6*a* except that the opposing leg assemblies are open.

Figure 7:
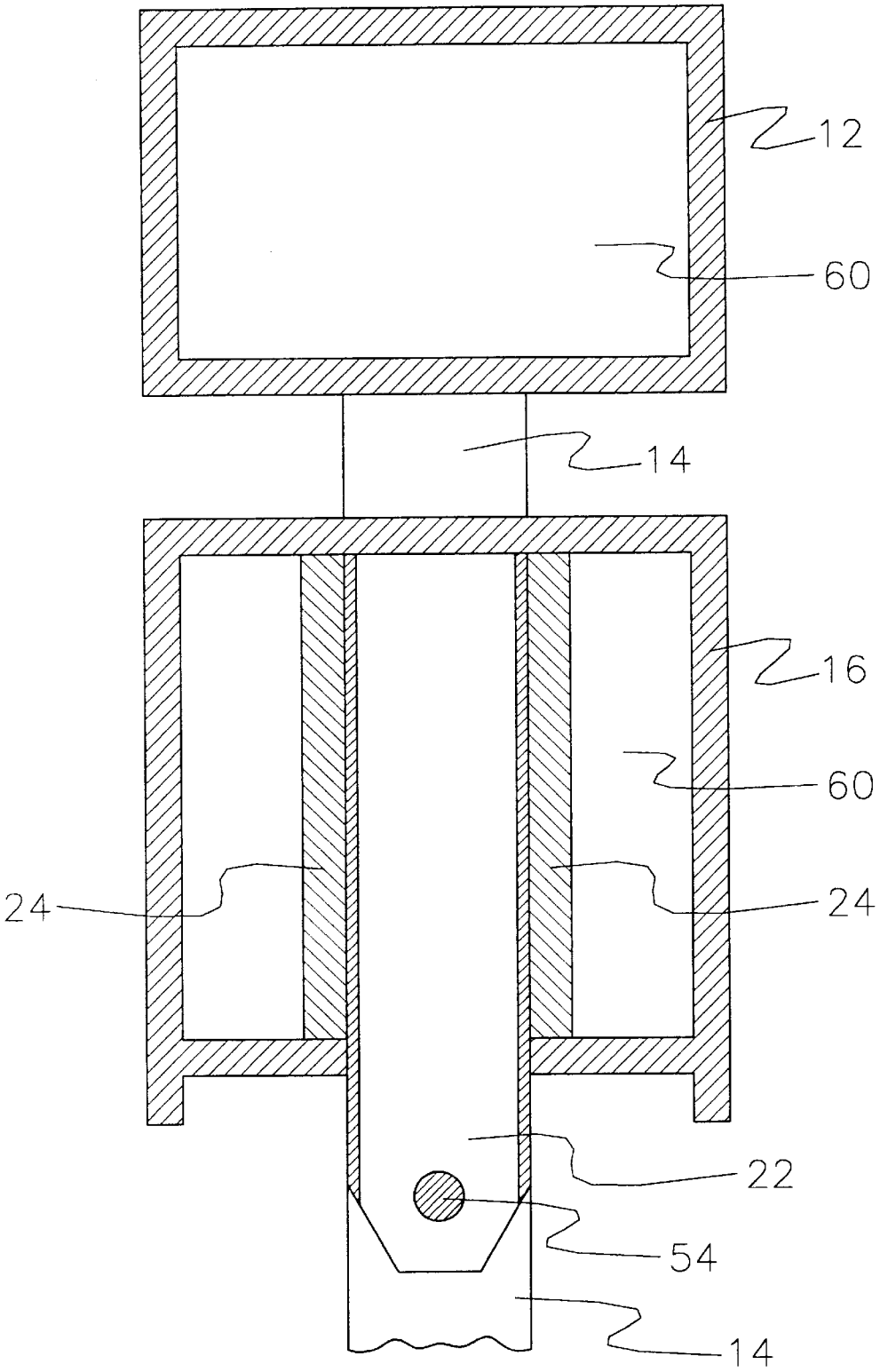

FIG. 7 shows a sectional view along the transverse center line of the fixed post and is presented to illustrate the relationship between the fixed lower beam and the fixed post.

Figure 8:
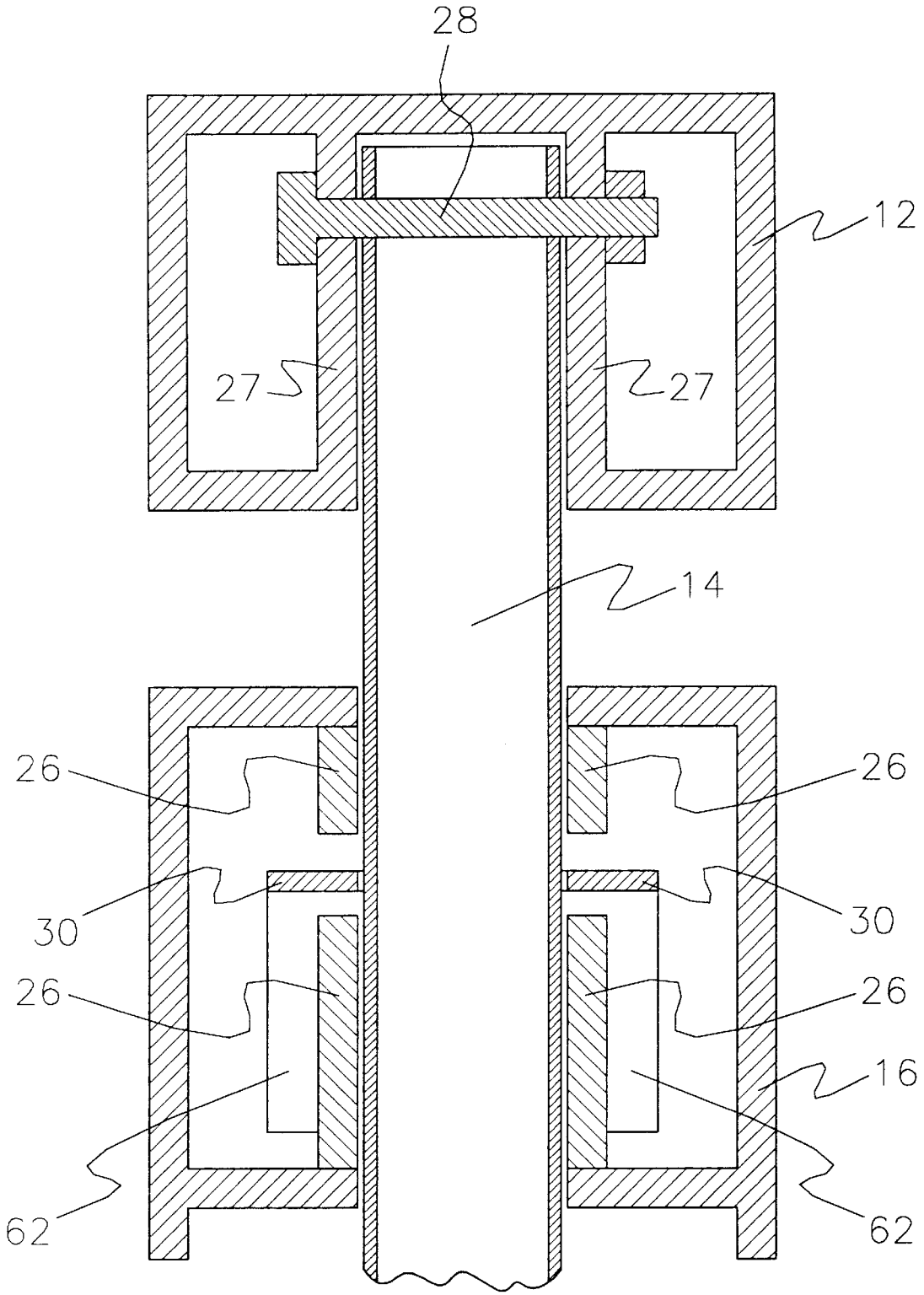

FIG. 8 shows a sectional view along the transverse centerline through the sliding support, and is presented to illustrate the relationship between the sliding support, the height adjustable upper beam, the fixed lower beam, and the associated friction lock.

REFERENCE NUMERALS IN THE DRAWINGS

10 adjustable height and levelable work support
12 height adjustable upper beam
14 sliding support for upper beam
16 fixed lower beam
18 fixed length leg
20 adjustable length leg
22 fixed post for legs attachment
24 fixed post cuff
26 sliding support cuff
27 sliding support pocket
28 fastener/pivot for sliding support
30 sliding support friction lock
32 friction lock release rod
34 friction lock release fulcrum
36 adjustable length leg bracket
38 adjustable length leg cuff
40 release rod access
42 adjustable length leg friction lock
44 friction lock pivot support
46 friction lock retainer
48 leg adjustment limit slot
50 leg adjustment limit pin
52 release lever spring
54 fastener/pivot for leg assemblies
56 fixed length leg bracket
58 fixed length leg cuff
60 internal beam stiffener
62 friction lock release lever
64 sliding support stop
66 leg pad

DETAILED DESCRIPTION OF THE PROPOSED EMBODIMENTS

Figure 1A:
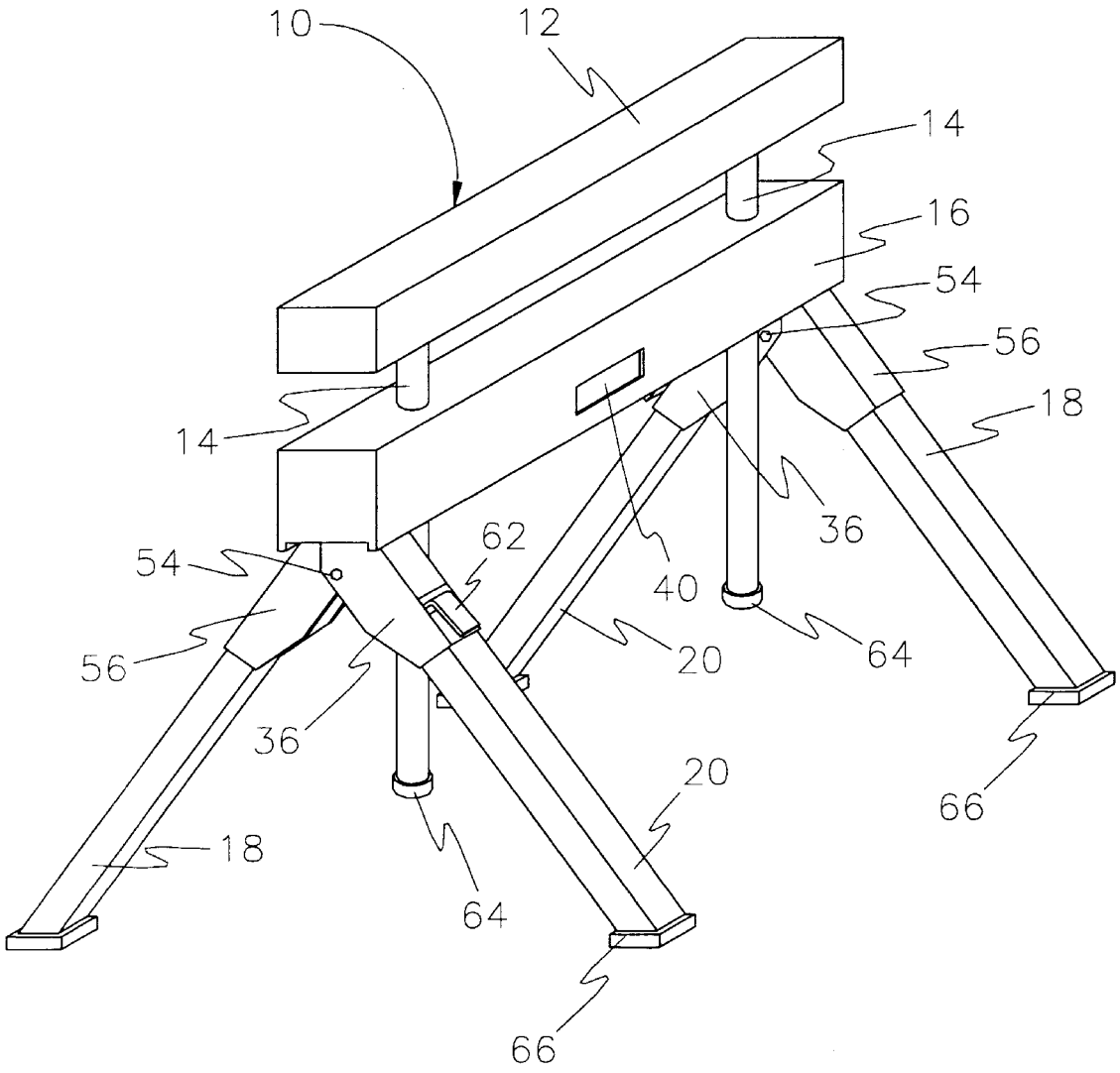
Figure 1B:
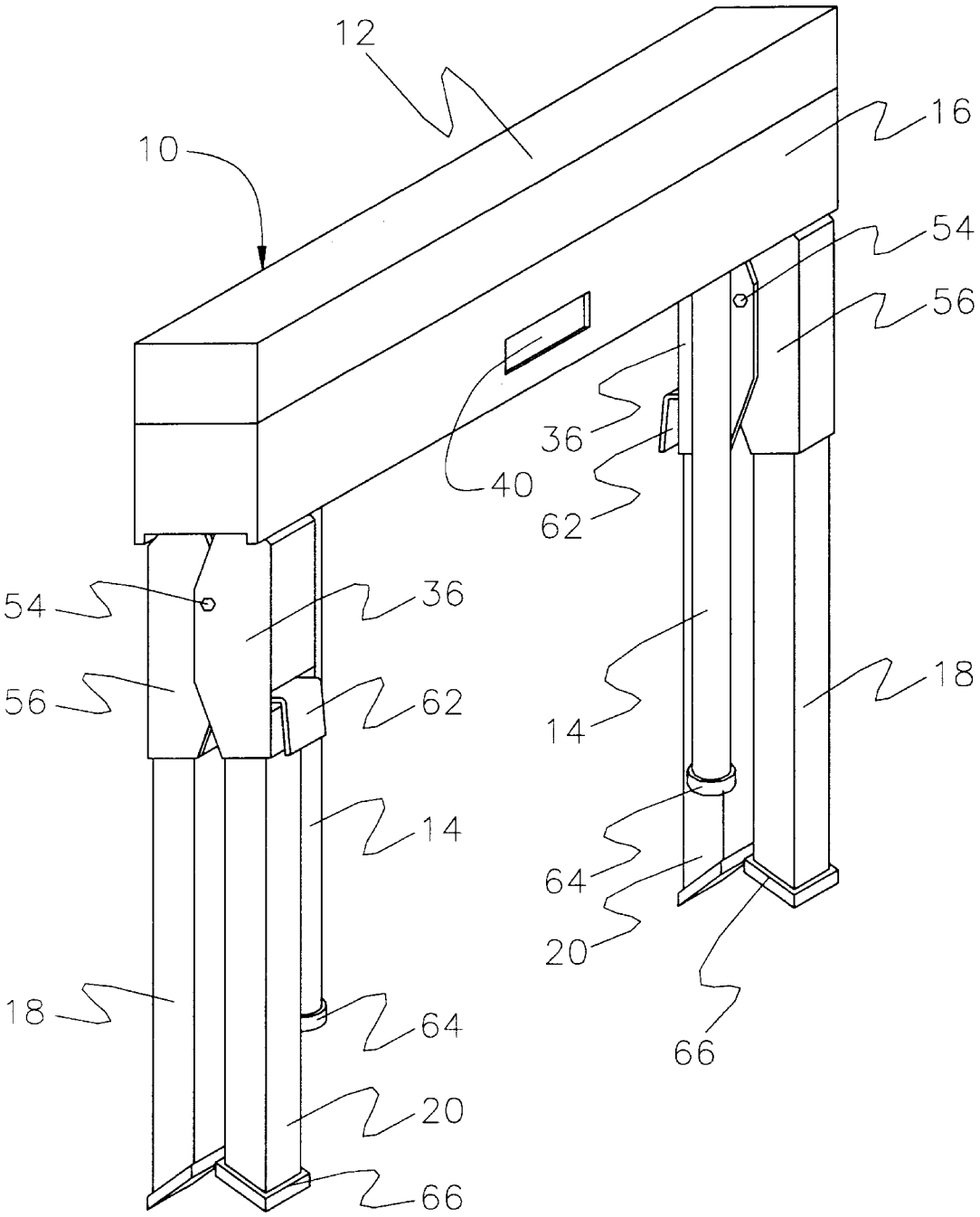
Figure 2:
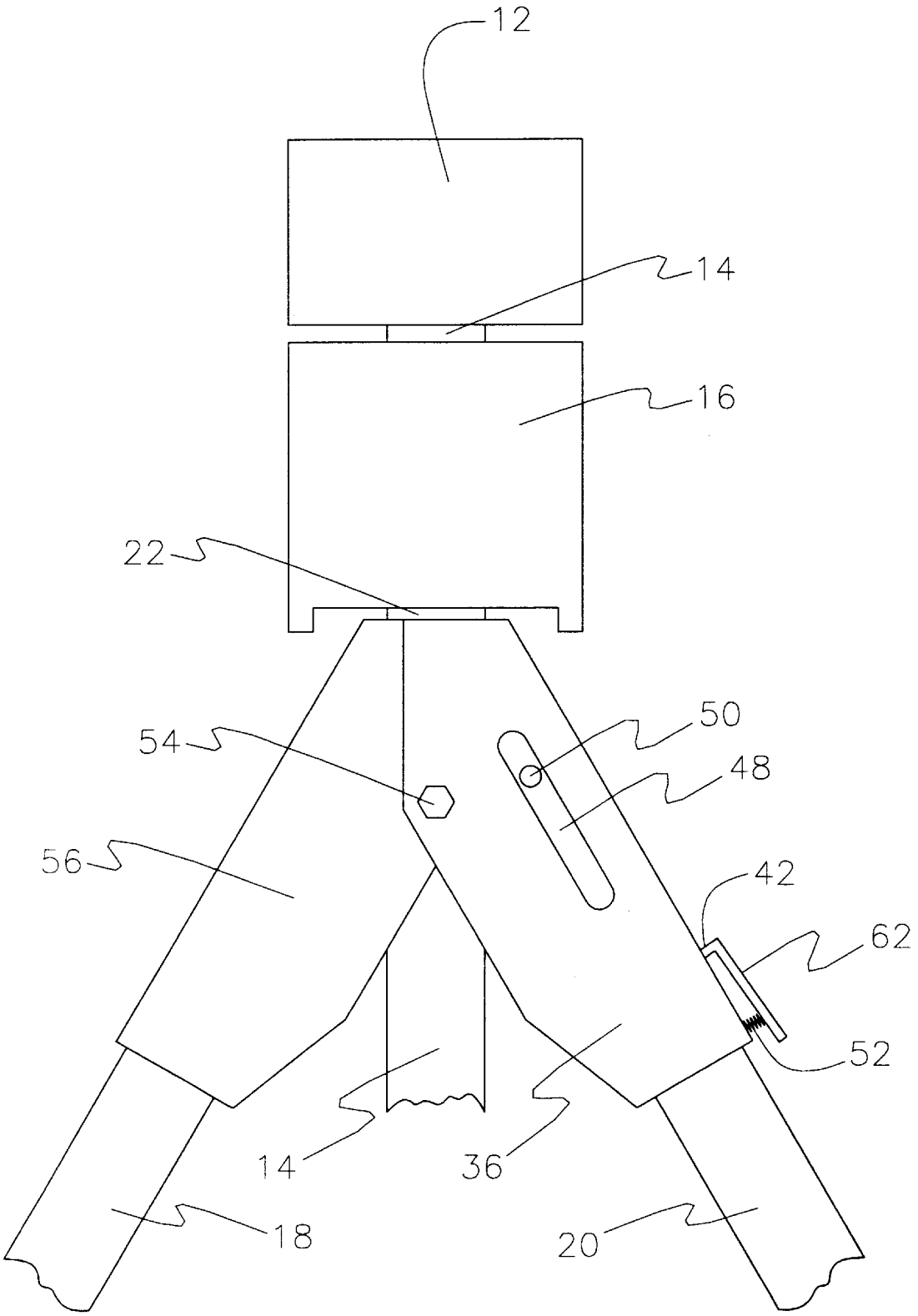
FIG. 2 shows an end view of the height adjustable upper beam, the fixed lower beam, two opposing leg assemblies in the open position, secured to a fixed post extending from the lower beam.
Figure 3:
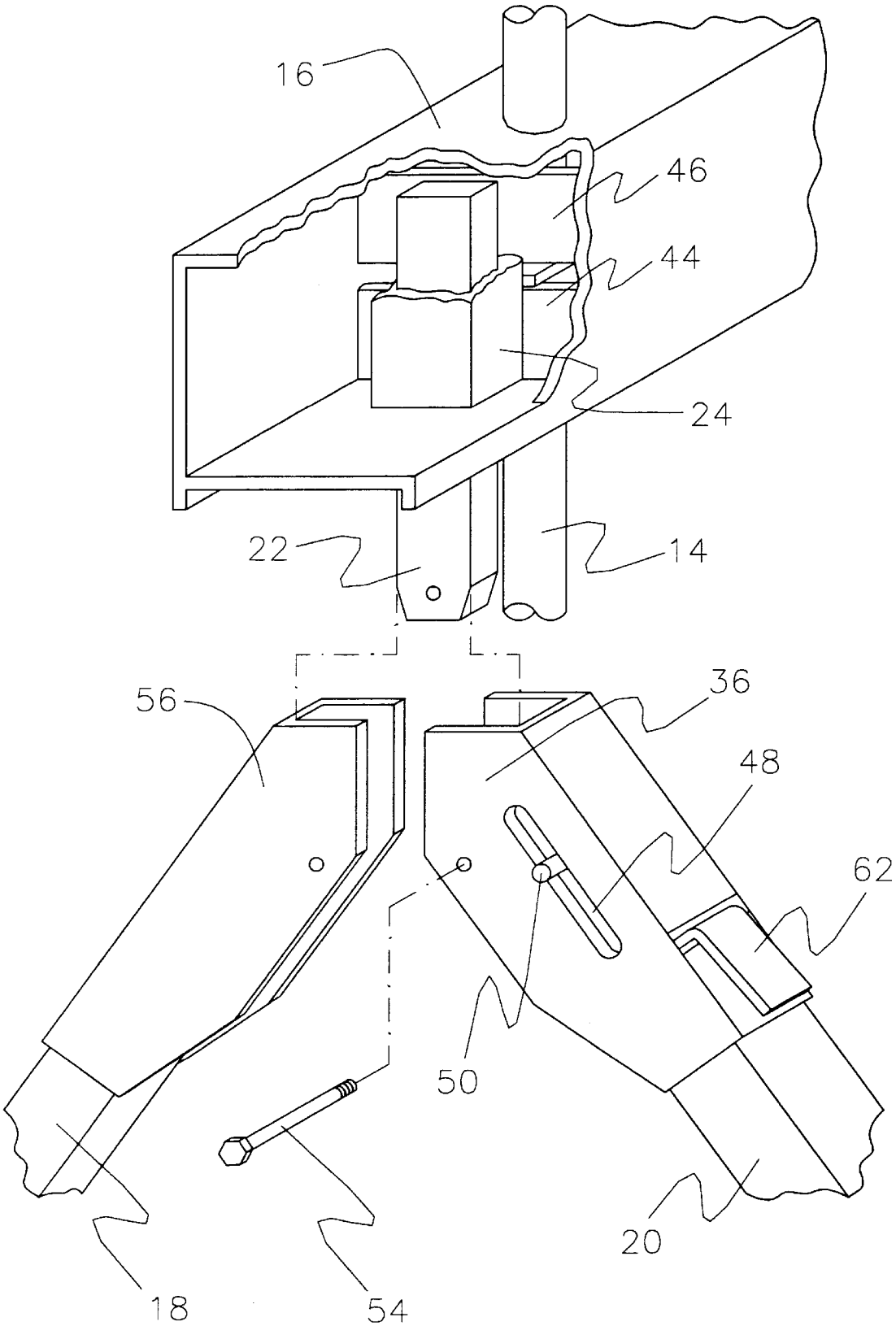
FIG. 3 shows an exploded perspective view that depicts the relationship of two opposing leg assemblies and the means of attachment to the fixed post that is secured to the lower fixed beam.
Figure 4:
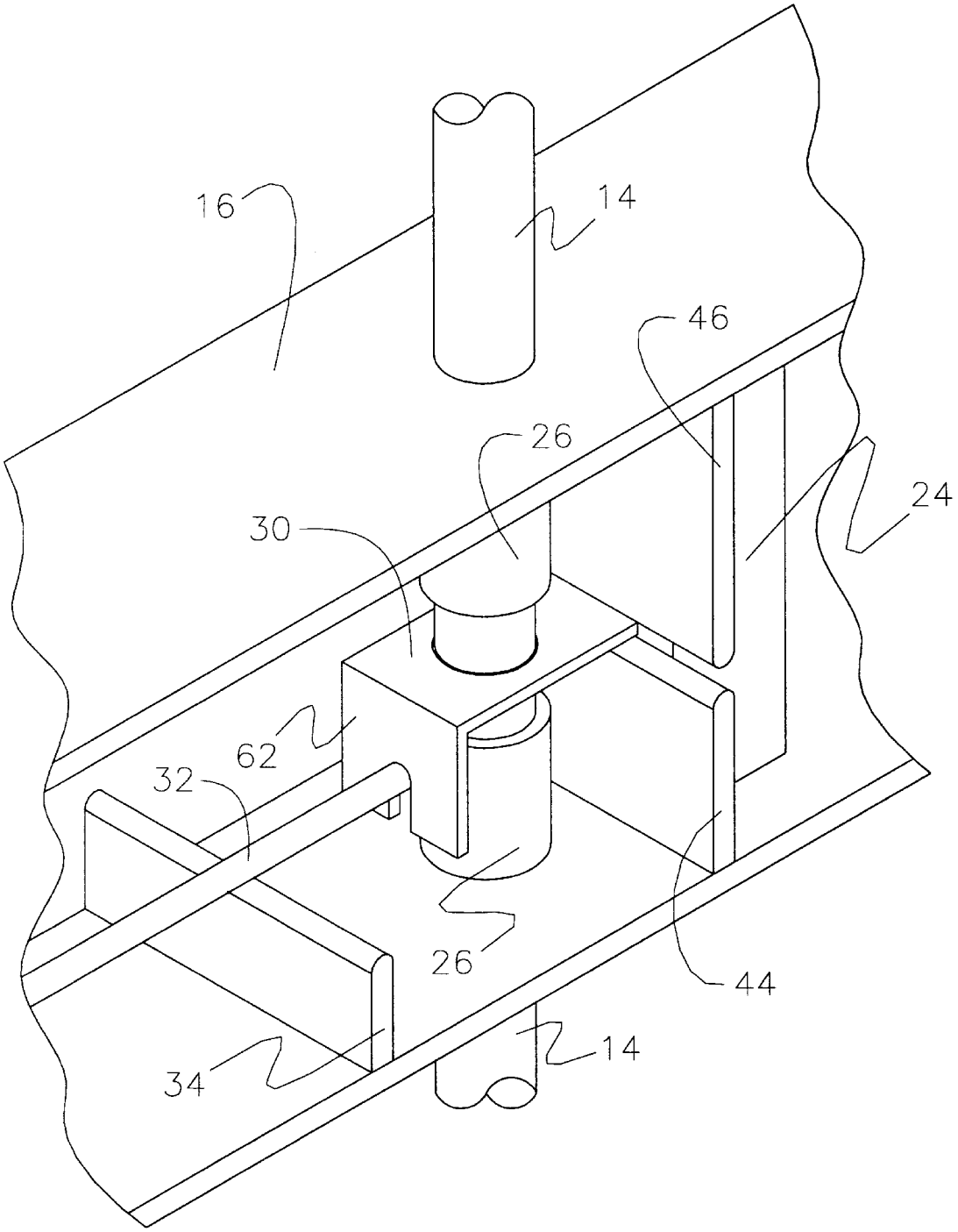
FIG. 4 shows a perspective view of a portion of the fixed lower beam containing the friction lock assembly, the release mechanism, and the associated sliding support for the upper beam.

In the illustrated embodiment of the invention, FIG. 1*a* shows the work support 10 in an open condition, ready for use. FIG. 1*b* illustrates the same embodiment shown in a closed condition, ready for transportation or storage.

The work support as illustrated consists of a height adjustable upper beam 12, attached through a fastener/pivot 28 to the upper end of two sliding supports 14 located near opposing ends of the upper beam 12. The sliding supports 14 allow independent vertical movement of the ends of the upper beam 12 relative to the fixed lower beam 16. The two sliding supports 14 stabilize the upper beam 12 by passing vertically through their respective cuffs 26 located in the lower fixed beam 16. Each of the two sliding supports 14 has an associated cuff 26 positioned in the fixed lower beam 16, creating a guide in which the sliding supports 14 can move.

Each of the two sliding support cuffs 26 consists of an upper and lower section to allow placement of a sliding support friction lock 30, and is securely fastened to the internal structure of the lower fixed beam 16. The internal dimensions of the cuffs 26 are sized to allow vertical movement of the associated sliding supports 14 but still restrict lateral movement that would affect stability of the upper beam 12. One sliding support tube 14 is located near each end of the upper beam 12 and is attached such that the sliding support tubes 14 form a right angle to the transverse axis of the upper beam 12. The fastener/pivot 28 also acts as a pivot point around which limited longitudinal rotation relative to the upper beam 12 is permitted by raising one end of the upper beam 12 independent of the opposing end. The ability to raise one end independently provides the means to longitudinally level the upper beam 12.

The two sliding support tubes 14 pass through their respective cuffs 26 which are secured at right angles both longitudinally and transversely within the body of the fixed lower beam 16. A friction lock 30, the generally horizontal portion of which encircles the associated sliding support tube 14, is located between the upper and lower sections of each of the two sliding support cuffs 26.

The two sliding support tubes 14 are locked at any point throughout their range of vertical height by the two friction locks 30. One friction lock 30 is used at each of the two sliding support tubes 14. The friction locks 30 consist of a generally horizontal portion that provides the locking action, and a generally vertical portion identified as a friction lock release lever 62, the two portions being at approximately a right angle to each other forming one piece. The locking portion of the friction locks 30 contains an opening that is the same shape as the support tube 14 that passes through it, but that is slightly larger in dimension than the support tube 14 that it acts upon. The friction lock release lever portion 62 contains a centrally located vertical slot that retains one end of a floating friction lock release rod 32 and prevents transverse movement of the release rod 32 relative to the lower fixed beam 16. The vertical slot is slightly larger in dimension than the friction lock release rod 32 that it retains.

The friction locks 30 encircle the support tubes 14 and are offset from perpendicular relative to the longitudinal axis of the support tubes 14 by the action of gravity. The friction locks 30 are supported at the end of the locking portion by a pivot support 44 and retained in relative position by a friction lock retainer 46. The friction locks 30 thus allow the raising of the support tubes 14 but will immediately lock against the exterior surface of the support tubes 14 when downward motion is initiated. The locking is nearly instantaneous in that no downward movement of the upper beam 12 is noticeable prior to the locking action.

The two friction locks 30 are released from their locked position through the upward movement of the two ends of the floating release rod 32 where the ends meet with the associated friction lock release lever 62. The upward movement of the floating release rod 32 is confined to the end portions of the release rod 32 that extend beyond a friction lock release fulcrum 34, one fulcrum being located a short distance back from each of the two ends of the release rod 32. The two fulcrums 34 provide pivot points around which limited rotation of the release rod 32 occurs, and also support the release rod 32 at an appropriate height relative to the two friction lock release levers 62. The upward rotational movement at the ends of the release rod 32 results from downward movement of the release rod 32 at a point that is approximately midway between the two lock release fulcrums 34. The downward movement is applied by a finger being inserted into a release rod access 40 located in the lower fixed beam 16, and then pressing downward on the release rod 32. The upward rotational movement of the ends of the release rod 32 contact the top of the slots in the release levers 62, raising the associated friction locks 30, thereby unlocking the sliding supports 14.

The friction locks 30 will immediately lock the support tubes 14 in place when the ends of the release rod 32 no longer exert upward pressure on the friction lock release levers 62.

The release rod 32 is comprised of a material that is resilient or elastic in nature and will retain its integrity through repeated deflections as long as the deflections are within acceptable limits. The deflection limits of the release rod 32 cannot be exceeded as the bottom member of the fixed beam 16 limits the available downward deflection, while upward deflection, though not necessary for operation, is limited by internal beam stiffeners 60. Lateral movement of the release rod 32 is likewise restricted by internal beam stiffeners 60 and the slots in the two friction lock release levers 62.

The two fixed post cuffs 24 are located near opposing ends of the lower fixed beam 16, and serve to secure and correctly position the associated fixed post for legs attachment 22. The two fixed posts 22 are positioned so that they are at a right angle both longitudinally and transversely to the axes of the fixed lower beam 16, and extend through the bottom of the fixed lower beam 16 to provide a means of attachment for the leg assemblies.

Two pairs of opposing leg assemblies are attached to the two fixed posts 22 using a fastener/pivot for leg assemblies 54 that slides through a hole in two opposing side members of an adjustable leg support bracket 36, a hole in two opposing side members of a fixed leg support bracket 56, and a hole through the fixed post 22. The two leg support brackets 36 & 56 are placed so that they bracket the fixed post 22, one from each side, one bracket being of smaller dimension so that the smaller will nest inside the larger dimensioned bracket, thus allowing the alignment of the holes for the fastener/pivot 54. With the described holes aligned and the fastener/pivot 54 inserted, the fastener/pivot 54 also serves as a pivot, allowing the two legs to close together to a width that is similar to the width of the fixed lower beam 16, and to open to their full range of movement.

An adjustable length leg 20, an associated leg cuff 38, and the associated support bracket 36, in association with an adjustable length leg friction lock 42 and its related parts, form an assembly that allows the operator to adjust leg length in order to stabilize the work support 10 on an uneven bearing surface. The leg length adjustment also allows the operator to affect the level of the work support 10 in a transverse direction.

The adjustable length leg 20 slides through the leg cuff 38 for a distance that is limited by the length of two leg adjustment limit slots 48 and an associated leg adjustment limit pin 50. The limit pin 50 is fixed in a through hole located near the upper end of the adjustable length leg 20 and is of a length sufficient to extend into the two adjustment limit slots 48, one slot located in each of the two support bracket 36 members. The two adjustment limit slots 48 and the hole through the adjustable length leg 20 are aligned to allow the limit pin 50 to act as a stop when leg length is adjusted.

The adjustable length leg 20 passes through the leg cuff 38 which is secured within the body of the support bracket 36. The surrounding leg cuff 38 consists of an upper and lower section to allow placement of an adjustable leg friction lock 42. The internal dimensions of the leg cuff 38 are sized to allow movement of the associated adjustable length leg 20, but still restrict lateral movement that would adversely affect the stability of the leg. The adjustable leg friction lock 42 is located between the upper and lower sections of the leg cuff 38.

The adjustable length leg 20 is locked at any point throughout the range of length adjustment by the friction lock 42. The friction lock 42 consists of a locking portion and a friction lock release lever portion 62, the two portions being at approximately a right angle to each other forming one piece. The locking portion of the friction lock 42 contains an opening that is the same shape as the adjustable leg 20 that passes through it but is slightly larger in dimension than the adjustable leg 20 that it acts upon, while the other portion serves as a lock release lever 62. The friction lock is supported at the end of the locking portion by a friction lock pivot support 44 and retained in its relative position by a friction lock retainer 46, both being fixed inside the leg bracket 36.

A release lever spring 52 is used to promote positive locking of the associated adjustable leg 20, preventing the leg length from decreasing. The friction lock 42 allows lengthening of the adjustable leg 20 at any time, within the limits of available length adjustment. Decreasing the length of the adjustable leg 20 requires finger pressure on the release lever 62, causing the friction lock 42 to unlock, thereby freeing the associated adjustable leg 20. The leg length is immediately locked in position when pressure on the release lever 62 is removed.

A fixed length leg 18, a fixed length leg cuff 58, and a fixed length leg support bracket 56 form a non-adjustable assembly that is illustrated in the drawings as opposing the adjustable length leg 20 assembly, thereby forming a pair of leg supports that are attached to the fixed post 22.

The fixed leg support bracket 56 is dimensioned to nest inside the adjustable leg support bracket 36, thus allowing the alignment of the holes in the two support brackets 36 & 56 to facilitate the insertion of the fastener/pivot 54.

The described opposing set of two legs is constructed with identical but opposite angles at the top end of each of the leg assemblies. The angle determines the available outward movement of the set of two legs by contacting opposing sides of the fixed post 22. The pivot point formed by the fastener/pivot 54 is located relative to the angled ends of the two opposing leg assemblies so that the sides of the fixed post 22, and the face of the angle at the top of each of the two leg assemblies, form parallel surfaces that are in full contact with each other when the opposing legs are in the full open position. This juxtaposition of the described parallel surfaces contributes to the stability of the work support 10 in that as increasing load is applied to either the upper beam 12 or the lower beam 16, the described parallel surfaces come into even closer contact with each other virtually eliminating instability.

Sliding support stops 64 are located at the bottom end of each sliding support 14 to limit the amount of height adjustment. Leg pads 66 are located at the end of each leg to provide additional stability and floor protection.

OPERATION

The manner of using the work support 10 is similar to the traditional sawhorse but its utility is greatly expanded by the ability to level the work support to compensate for an uneven bearing surface, and by the ability to raise the upper beam 12 to the desired height.

The operator removes the work support 10 from storage and after manually opening the two pairs of legs, places it on the floor. If necessary to stabilize the work support 10 caused by an uneven bearing surface, the length of an adjustable leg 20 is changed by grasping the leg bracket 36 with one hand, grasping the adjustable leg 20 in the other hand, and pulling downward the desired distance. The friction lock 42 immediately locks the leg in the lengthened position. Length of the leg is decreased by grasping the leg bracket 36 with one hand, and the exposed friction lock release lever 62 with the other hand, and then pushing downward on the leg bracket 36. Releasing the release lever 62 immediately locks the leg in the shortened position. When the operator is satisfied with the stability and the level of the work support in the transverse direction, leg adjustment is complete.

Should the operator require a greater height above the floor than is offered with the two work support beams 12 & 16 closed, the upper beam 12 is grasped and raised until the required height is reached. The two sliding support friction locks 30 immediately hold the position of the upper beam 12 when upward movement ceases.

If the operator requires that the upper beam 12 be leveled longitudinally, one end of the upper beam 12 is lifted the desired distance. The upper beam 12 is immediately locked in place by the friction locks 30 when a level condition is reached and upward movement ceases.

When the work support 10 is no longer needed the operator reaches down to the release access 40 and by pressing down with a finger on the lock release rod 32, the two sliding supports 14 holding the upper beam 12 are released. Through the action of gravity the upper beam 12 closes to rest on the top surface of the lower beam 16. The work support 10 is then tipped to one side freeing two legs from the floor. The freed legs are pivoted to a closed position manually and the work support 10 is ready for storage or transport.

SUMMARY

Accordingly, the reader will understand that the work support of this invention can be readily manufactured from readily available materials and is simple in construction, although close tolerances must be observed for the locking and release mechanisms, as well as the sliding components and their related cuffs.

This invention is particularly useful in elevating a work piece to the desired work height with the added benefit that a large work piece, such as 4 feet by 8 feet, can be stabilized by using two or more work supports, and leveling the top work support beams to exactly match the bottom surface of the work piece. The ability to match work supports to the bottom surface of a large work piece creates a stable platform for the craftsman and is particularly useful when cutting away portions of the large piece.

The work support is also suited for the support of one end of a long work piece that extends beyond a work table. The work support has the capability of adjusting to a height matching the typical work bench height, and then being leveled to match the plane of the work table, creating a stable condition for the work piece.

Height adjustment of the upper beam is a one-handed operation. Raising the beam uses one hand in the approximate center of the beam and leveling is accomplished by moving the hand to one end of the beam and lifting. Locking the upper beam in the desired position is immediate and requires no input from the operator. Closing the beam is equally simple and is accomplished by moderate finger pressure on the release rod located inside the lower beam.

An additional feature is the ability of the work support to clamp and hold a work piece between the two beams. A work piece can be placed between the top of the lower fixed beam and the bottom of the upper adjustable beam, and the upper beam lowered to rest on the work piece so inserted. The two beams create a clamping action holding the work piece in position. This use is applicable to light duty only as the friction locks do not hold the upper beam in the down position. The clamping action between the beams is limited by the weight of the upper beam in its ability to hold a work piece in place.

When finished with the work support, the operator lowers the upper beam to rest on the lower beam, tips the work support to one side, freeing two of the legs from the floor. The freed legs are manually closed and the work support is ready for transport or storage.

The reader should note that there are no screws, bolts, knobs, braces, etc. to remove, rotate, or fasten to operate the work support. The work support greatly expands the usefulness of examples of prior art, and is simple to operate with no extraneous pieces to come unscrewed or separated and lost.

RAMIFICATIONS

Although the preceding description contains many specifics, these should not be construed as limiting the scope of the invention but as merely providing illustrations of some of the presently preferred embodiments of this invention. For example, the length and width of the beams can be expanded, the shape of the leg brackets can be changed to accommodate available materials, or the lengths of the legs and sliding supports can be altered. Leveling tubes that are commonly used in a carpenters level can be installed in the upper beam, simplifying the longitudinal and transverse leveling procedure. A separate replaceable cover to protect the upper beam surfaces from suffering tool damage during use can be fitted to the beam. Such protection should greatly increase the useful life of the work support. Also, when using two work supports, strategically located vertical holes through the upper beam could be made available to provide attachment of a working surface, thus creating a temporary work table. Utilizing the upper beam movement, the two work supports so used could be angled towards the user, creating a comfortably slanted work surface similar to a drafting table.

As illustrated in the figures, two of the legs are adjustable length legs. The preceding illustrations and descriptions are not meant to limit the number of adjustable length legs at two per work support unit. Under conditions such as a construction site it may be desirable to provide a work support unit with four adjustable length legs to compensate for particularly uneven support surfaces.

Another embodiment would be the inclusion of three or four adjustable length legs to give the operator more versatility in leveling the work support unit on an uneven bearing surface. Or conversely, another embodiment would be four fixed length legs, and a modification to the height adjustable upper beam that allows transverse leveling of the upper beam.

Still another embodiment would be the repositioning of the adjustable leg friction lock that would allow gravitational forces to act in a manner similar to the friction locks for the sliding supports. Such repositioning would negate the need for a spring, and would simplify the locking system for the adjustable length legs.

Additional embodiments other than described above are possible, such as using square sliding supports in place of the round sliding supports illustrated, or round legs in place of the square legs illustrated, and could be incorporated in the design and construction of the work support.

Other embodiments of the invention are possible from those described or illustrated. Such embodiments would be directed to increase the ease of manufacturing, availability of materials, simplify construction in order to reduce cost, expand the scope of usefulness, or enhance the ease of operation.

SCOPE

Thus the scope of the invention should be determined by the appended claims and their legal equivalents, and is not limited to the examples presented.

I claim:

1. A work support comprising in combination:

(a) a generally horizontal first beam;

(b) a plurality of legs connected to support first and second end portions of the first beam;

(c) a generally horizontal second beam and separate, spaced apart first and second pivot supports attached to the second beam;

(d) first and second uprights pivotally connected to the first and second spaced pivot supports of the second beam;

(e) first and second rigid guides in the first beam engaging the first and second uprights, respectively, to maintain the first and second uprights parallel as the second beam is raised and lowered relative to the first beam; and (f) first and second releasable friction locks engaging the first and second uprights, respectively, to allow upward movement of the first and second uprights relative to the first beam and resist downward movement of the first and second uprights relative to the first beam, the first and second releasable friction locks being releasable to allow downward movement of the first and second uprights relative to the first beam in response to a releasing force wherein the first and second uprights are cylindrical, wherein the first releasable friction lock includes a generally horizontal first tiltable plate having a circular clearance hole through which the first upright extends, a first portion of the first tiltable plate engaging a first rigid support such that when the first upright receives a downward force from the second beam the first tiltable plate tilts downward about the first rigid support causing edge portions of the circular clearance hole to engage and grip a cylindrical surface of the first upright and the first rigid support supports the first tiltable plate and hence also the first upright and the portion of the second beam pivotally supported thereby, and the second releasable friction lock includes a generally horizontal second tiltable plate having a circular clearance hole through which the second upright extends, a first portion of the second tiltable plate engaging a second rigid support point such that when the second upright receives a downward force from the second beam the second tiltable plate tilts downward about the second rigid support causing edge portions of the circular hole of the second tiltable plate to grip a cylindrical surface of the second upright and the second rigid support supports the second tiltable plate and hence also the second upright and the portion of the second beam pivotally supported thereby.

2. The work support of claim 1 including four of the legs, a first pair of which are connected to the first end portion of the first beam, a second pair of which are connected to the second end portion of the first beam, the length of one leg of the first pair being adjustable, and the length of one leg of the second pair being adjustable.

3. The work support of claim 2 wherein the one leg of the first pair and the one leg of the second pair are disposed on opposite sides of the first beam.

4. The work support of claim 1 wherein the first and second beams lie in a generally vertical plane.

5. The work support of claim 4 including first and second pivot mechanisms including the first and second pivot supports, respectively, which allow tilting of the second beam relative to the first beam only in the vertical plane.

6. The work support of claim 1 including a first release mechanism engaging a second portion of the first tiltable plate opposed to the first portion thereof to untilt the first tiltable plate so as to cause the edge portions of the circular hole to release the first upright, the first release mechanism being adapted to respond to a first applied release force to untilt the first tiltable plate, the work support including a second release mechanism engaging a second portion of the second tiltable plate opposed to the first portion thereof to untilt the second tiltable plate so as to cause the edge portions of the circular hole therein to release the second upright, the second release mechanism being adapted to respond to a second applied release force to untilt the second tiltable plate.

7. The work support of claim 6 including four of the legs, a first pair of which are connected to the first end portion of the first beam, a second pair of which are connected to the second end portion of the first beam, the length of one leg of the first pair being adjustable, and the length of one leg of the second pair being adjustable, wherein a first one of the adjustable legs includes an upper first member connected to the first end portion of the first beam and a lower second member which telescopes with respect to the upper first member.

8. The work support of claim 7 wherein one of the adjustable legs includes a third releasable friction lock adapted to allow lengthening the first adjustable leg by exertion of a downward force tending to pull the lower second member out of the upper first member and resist exertion of an upward force tending to push the lower second member into the upper first member.

9. The work support of claim 8 wherein the third releasable friction lock includes a third tiltable plate which generally lies in a plane perpendicular to a longitudinal axis of the lower second member.

10. The work support of claim 9 wherein the third releasable friction lock includes a return spring to promote positive locking of the upper first member to the lower second member.

11. The work support of claim 6 including a floating release rod retained by first and second spaced fulcrum elements located between the first and second tiltable plates such that applying a transverse release force to the middle of the release rod causes opposed ends of the release rod to engage the second portions of the first and second tiltable plates, respectively.

12. The work support of claim 1 wherein the first and second beams are hollow web-reinforced beams.

13. The work support of claim 1 wherein the first and second uprights include hollow cylindrical tubes.

* * * * *